United States Patent [19]

Gronbech

[11] 4,391,417

[45] Jul. 5, 1983

[54] UNCOILER FOR METALLIC STRIP MATERIAL

[75] Inventor: Robert W. Gronbech, Sheffield, England

[73] Assignee: Davy-Loewy Limited, Sheffield, England

[21] Appl. No.: 252,866

[22] Filed: Apr. 10, 1981

[30] Foreign Application Priority Data

Apr. 10, 1980 [GB] United Kingdom ..... 8011895

[51] Int. Cl.[3] ..... B21C 47/16; B65H 75/00

[52] U.S. Cl. ..... 242/78.6; 242/54 R; 242/128; 242/75.51

[58] Field of Search ..... 242/78.6, 78.7, 78.8, 242/78, 54 R, 128, 129, 68.2, 67.1 R, 67.3 R, 75.43, 75.44, 75.45, 75.51

[56] References Cited

U.S. PATENT DOCUMENTS

| | | | |
|---|---|---|---|
| 2,246,840 | 6/1941 | Crone | 242/78.7 |
| 3,162,394 | 12/1964 | Culpepper | 242/78.6 |
| 3,544,029 | 12/1970 | Meier | 242/78.6 |

*Primary Examiner*—Edward J. McCarthy

*Attorney, Agent, or Firm*—Schwartz & Weinrieb

[57] ABSTRACT

An uncoiler for metallic strip material may suffer from rotational effects of a coil supported on the mandrel if the coil is eccentrically mounted on the mandrel. The uncoiler has means for detecting these rotational effects and, if the effects are greater than a predetermined level, a signal is prepared which is used either to prevent further increase in rotational speed of the mandrel or to reduce the speed of the mandrel.

6 Claims, 3 Drawing Figures

UNCOILER FOR METALLIC STRIP MATERIAL

FIELD OF THE INVENTION

The present invention relates generally to coiled metallic strip material, and more particularly to uncoiler apparatus for detecting the degree of eccentricity of the coiled strip material disposed upon a mandrel, and for controlling the speed of the movement of the strip material and the rotation of the mandrel and the coiled strip in response to the detected degree of eccentricity.

BACKGROUND OF THE INVENTION

During the production of metallic strip material, it is usual to coil the unfinished strip material into coils and subsequently to unwind the strip material and pass it through a finishing process. This process may involve further rolling of the material. The coils of strip material are positioned in turn on a rotatable mandrel of an uncoiler and the strip is unwound from the coil when it is in position on the mandrel. As the strip material is withdrawn from the coil on the mandrel, the mandrel is rotated and very high rotational speeds may be encountered. If the coil is accurately located on the mandrel, so that the axis of the coil is substantially coaxial with the longitudinal axis of the mandrel, then out-of-balance forces on the mandrel and its supports, as the mandrel is rotated, are reduced to a minimum. If, however, as sometimes occurs, the bore of the coil is damaged or the inner turn of the coil is folded into the bore of the coil, then the coil is positioned eccentrically on the mandrel and, when the mandrel is rotated, the out-of-balance forces on the mandrel and its supports are considerable and damage to the mandrel and to its support bearings can occur.

SUMMARY OF THE INVENTION

According to the present invention, an uncoiler for metallic strip material has a rotatable mandrel for supporting a coil of strip material and means by which the rotational effects of a coil of strip material eccentrically supported on the mandrel can be detected.

If, in use, the detecting means detects rotational effects, such as out-of-balance forces, due to the coil of strip material being eccentrically supported on the rotating mandrel, then the output signal of the detecting means can be compared with a signal of predetermined value, and, if the detected value exceeds the predetermined value, then a signal is produced which is automatically used to either prevent further increase in the rotational speed of the mandrel or to slow down the rotational speed of the mandrel.

The detecting means may comprise a transducer positioned away from the outer curved periphery of the mandrel and arranged to detect the distance to the curved periphery of a coil on the mandrel. As the strip is withdrawn from the coil, the distance between the transducer and the periphery of the coil will progessively increase but, if the coil is eccentrically mounted on the mandrel, then the output signal from the transducer will be modulated by a signal depending upon the degree of eccentricity.

Alternatively, the detecting means may be associated with the supports for the mandrel so as to detect movement of the supports as the mandrel is rotated. If there are out-of-balance forces on the supports, then these will be detected and, if they are in excess of an acceptable value, a signal is produced which is used to automatically control the speed at which the strip material is withdrawn from the mandrel.

BRIEF DESCRIPTION OF THE DRAWINGS

In order that the invention may be more readily understood it will now be described, by way of example only, with reference to the accompanying drawings, in which.

DETAILED DESCRIPTION OF THE ILLUSTRATED EMBODIMENTS

Figure 1:
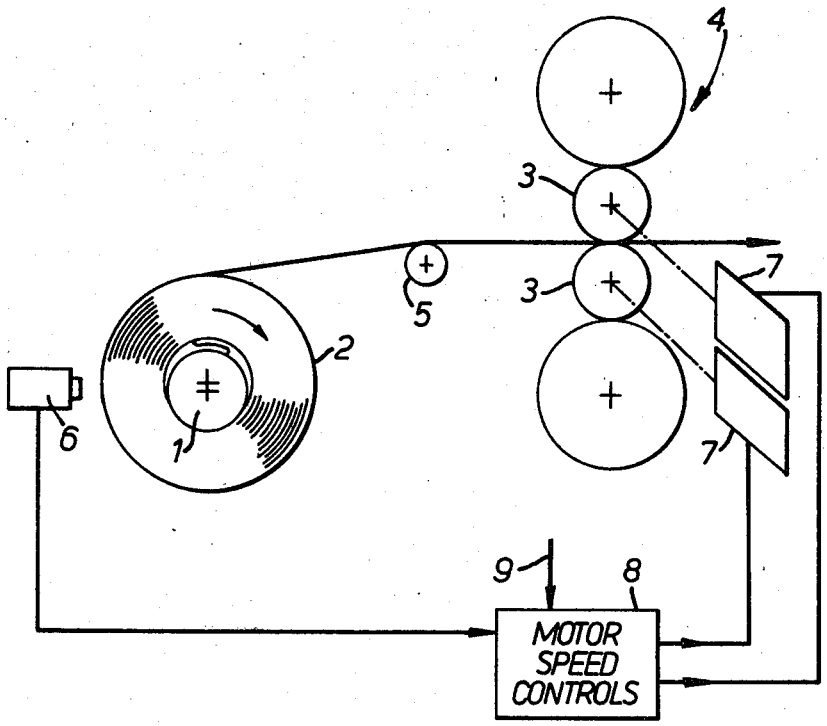
FIG. 1 is a diagrammatic side elevation of an uncoiler in accordance with the invention and a rolling mill.

In FIG. 1, the mandrel of an uncoiler is indicated by reference numeral 1. A coil of metallic strip material 2 is mounted on the mandrel and the strip material is fed to the roll gap between the work rolls 3 of a rolling mill 4 by way of an idler roller 5. A position transducer 6 is located adjacent to the outer curved periphery of the coil 2. The rolls 3 are rotatable by means of mill drive motors 7 and a motor speed control circuit 8 serves to control the speed of rotation of the motors. An output signal from the transducer 6 is supplied to the speed control circuit 8.

In use, the mill motors are energised to roll the strip material as it is withdrawn from the coil. The uncoiler is provided with braking means for keeping the strip material between the uncoiler and the mill rolls in tension. When the mandrel and the coil supported on it are rotated, there will be out-of-balance forces applied to the mandrel and its supports if, as is shown, the coil is eccentrically mounted on the mandrel. The extent of the out-of-balance forces will depend upon the weight of the coil, the speed of rotation and the degree of eccentricity. The transducer 6 provides an electrical signal representative of the distance from the transducer of the outer curved periphery of the coil. This distance will increase as the diameter of the coil reduces but the signal will be modulated if the surface of the coil moves towards and away from the transducer during each revolution of the mandrel due to the coil being eccentrically mounted on the mandrel. The output signal from the transducer is applied to the control circuit 8 where the component of the signal due to eccentricity is compared with a signal on line 9 representing a predetermined value of acceptable eccentricity.

If the signal representing actual eccentricity becomes equal to the predetermined value, then a further signal is produced which is used automatically to either slow down the mill motors 7 to reduce the out-of-balance movement of the mandrel to an acceptable level or to prevent the motor from increasing its speed.

Figure 2:
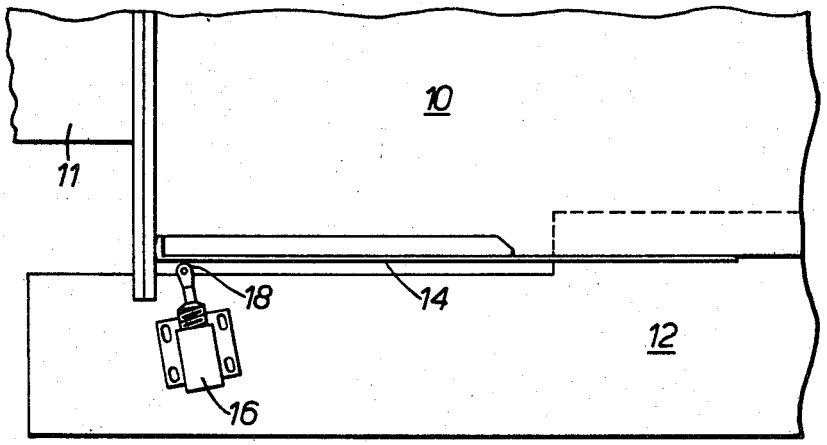
FIG. 2 is a diagrammatic plan of an alternative embodiment of the invention.
Figure 3:
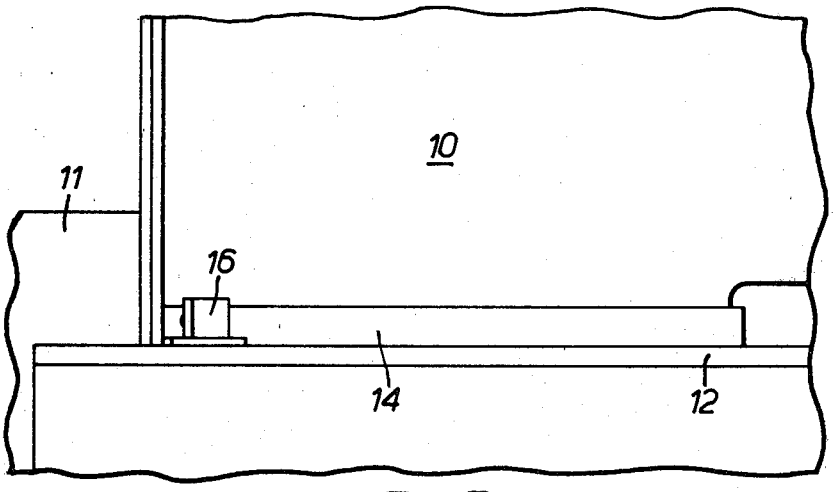
FIG. 3 is a side elevation of the embodiment shown in FIG. 2.

Referring to FIGS. 2 and 3, an uncoiler has a mandrel 11 which forms part of a structure 10. The structure is mounted in sliding relation on a pair of fixed slides 12, one of which is shown. The structure is slidable in the direction parallel to the longitudinal axis of the mandrel. A metal strip 14 forms part of the structure and extends parallel to the longitudinal axis of the mandrel. This strip is positioned close to one of the slides 12. On the slide there is positioned a position transducer 16 having a movable portion 18 bearing against the metal strip 14.

This portion 18 bears against the strip in all positions of the structure on the slides.

In use, with a coil supported on the mandrel, movement of the structure occurs in the direction normal to the longitudinal axis of the mandrel if the coil is eccentrically mounted on the mandrel. This movement, due to out-of-balance forces, is detected by the positioned transducer 16 which produces a signal representative of the movement of the structure relative to the slides.

If the signal representing the out-of-balance forces increases beyond a predetermined level representing acceptable maximum out-of-balance forces, then a signal is produced in a control circuit which either prevents the speed of rotation from being increased further or causes the speed of rotation to be reduced.

Obviously, many modifications and variations of the present invention are possible in light of the above teachings. It is therefore to be appreciated that within the scope of the appended claims, the present invention may be practiced otherwise than as specifically described herein.

I claim:

1. An uncoiler for metallic strip material, comprising:

mandrel means;

a coil of strip material, which is characterized by some degree of eccentricity, disposed upon said mandrel means;

means for moving said strip material so as to uncoil said strip material from said mandrel means; and means interacting with at least one of said eccentrically mounted coil of strip material disposed upon said mandrel means, or said mandrel means, for detecting said degree of eccentricity of said coil of strip material disposed upon said mandrel means, or the rotational effects of said eccentrically mounted coil of strip material, respectively, as said coil of strip material and said mandrel means are rotated by said moving means, and for controlling the speed of said moving means in response to said degree of eccentricity, or rotational effects, detected.

2. An uncoiler as claimed in claim 1, and including means for comparing an output signal of said detecting means with a signal representing a predetermined amount of said rotational effects to produce an output signal when said predetermined amount of said rotational effects is exceeded.

3. An uncoiler as claimed in claim 2, wherein said output signal is employed to either prevent an increase or cause a decrease in the rotational speed of the coil.

4. An uncoiler as claimed in claim 1, in which said mandrel means has support mounted on a slide and the detecting means comprises a transducer for detecting movement of said mandrel supports relative to the slide in the direction normal to the longitudinal axis of the mandrel.

5. An uncoiler as claimed in claim 4, in which the detector comprises a position transducer mounted on the slide and engageable with a portion of the mandrel supports movable towards and away from the slide.

6. An uncoiler as claimed in claim 1, in which the said detecting means comprises a detector spaced from the curved periphery of the mandrel and arranged to detect the distance to the curved periphery of a coil supported on the mandrel.

* * * * *